United States Patent [19]

Broersma

[11] Patent Number: 4,612,675

[45] Date of Patent: Sep. 23, 1986

[54] HELMET WITH ADJUSTABLE VENTILATION

[75] Inventor: Lester V. Broersma, Bellflower, Calif.

[73] Assignee: Bell Helmets Inc., Norwalk, Calif.

[21] Appl. No.: 709,216

[22] Filed: Mar. 7, 1985

[51] Int. Cl.[4] ..... A42B 3/02

[52] U.S. Cl. ..... 2/424; 2/425; 2/171.3; 2/436

[58] Field of Search ..... 2/424, 425, 414, 410, 2/411, 6, 10, 171.3, 9, 436, DIG. 1, 5

[56] References Cited

U.S. PATENT DOCUMENTS

| | | | |
|---|---|---|---|
| 694,986 | 3/1902 | Pierce | 2/414 |
| 935,556 | 9/1909 | Smith . | |
| 1,347,046 | 7/1920 | McDonough . | |
| 2,769,176 | 11/1956 | Gransay et al. . | |
| 2,846,683 | 8/1958 | Dye et al. . | |
| 2,991,478 | 7/1961 | Zbikowski . | |
| 3,082,428 | 3/1963 | Zbikowski . | |
| 3,310,811 | 3/1967 | Iacono, Jr. . | |
| 3,344,433 | 10/1967 | Stapenhill . | |
| 3,496,854 | 2/1970 | Feldmann et al. . | |
| 3,783,450 | 1/1974 | O'Connor . | |
| 3,873,997 | 4/1975 | Gooding . | |
| 3,925,821 | 12/1975 | Lewicki . | |
| 4,044,400 | 8/1977 | Lewicki et al. . | |
| 4,054,953 | 10/1977 | De Barsy | 2/425 X |
| 4,081,865 | 4/1978 | Bergee et al. | 2/425 |
| 4,247,960 | 2/1981 | Nava | 2/424 |
| 4,519,099 | 5/1985 | Kamiya et al. | 2/424 |
| 4,538,303 | 9/1985 | Schnitzler | 2/425 |

FOREIGN PATENT DOCUMENTS

| | | | |
|---|---|---|---|
| 0080202 | 6/1983 | European Pat. Off. | 2/425 |
| 2087220 | 5/1982 | United Kingdom | 2/425 |

*Primary Examiner*—Peter Nerbun

*Attorney, Agent, or Firm*—William W. Haefliger

[57] ABSTRACT

A motorcyclist's or bicyclist's helmet has dome shaped top wall structure, side wall structures, a front opening for forward viewing, a lower front wall structure which juts forwardly, and rear wall structure; and it also includes:

(a) a frontward facing air inlet defined by the lower front wall structure, (b) passage structure in the helmet to receive air inflow from the inlet for circulation to different portions of the interior of the helmet and subsequent flow to the helmet exterior, and (c) a closure carried by the helmet front wall for movement adjustably controlling said passage structure.

In addition, the helmet typically includes a shield, and said passage structure includes a primary passage to direct inflowing air toward the inner side of the shield, and a secondary passage to direct inflowing air rearwardly toward the interior of the helmet.

21 Claims, 16 Drawing Figures

HELMET WITH ADJUSTABLE VENTILATION

BACKGROUND OF THE INVENTION

This invention relates generally to helmets, and more particularly to a safety helmet of the type worn by motorcyclists and bicyclists, and having construction enhancing ventillation, eye shielding, anti-fogging, stability and comfort of the helmet, as worn.

In the past it was known to provide air vents in helmets, as for example are described in U.S. Pat. No. 3,496,854 to Feldman and U.S. Pat. No. 3,925,821 to Lewicki. Such helmets lack the unusually advantageous features of construction, modes of operation and beneficial results as are now provided in the present helmet, including air inlet flow control, both quantitatively and directionally, face shield position control and in cooperation with air flow control, and helmet stabilizing and ventillating padding.

SUMMARY OF THE INVENTION

It is a major object of the invention to provide an improved safety helmet incorporating the above unusual advantages, singly and in combination, and results. Fundamentally, the helmet incorporates a dome shaped top wall structure, opposite side wall structures, a front opening for forward viewing, a rear wall structure, and in some cases a lower front wall structure which extends forwardly.

It is one major object of the invention to provide, in this helmet environment:

(a) a frontward facing air inlet means defined by the lower front wall structure, (b) passage means in the helmet to receive air inflow from the inlet means for circulation to different portions of the interior of the helmet and subsequent flow to the helmet exterior, (c) and a closure carried by the helmet front wall structure for movement adjustably controlling said passage means.

As will be seen, the helmet may include a shield, the passage means including a primary passage to direct inflowing air toward the innerside of the shield; and the passage means may also include a secondary passage to direct inflowing air rearwardly toward the interior of the helmet. In this regard, the closure typically has a first position in which air inflow is passed by both said primary and secondary passages, it typically has a second position in which air inflow is passed by only one of said primary and secondary passages, and it may have a third position in which passage of air inflow by both said primary and secondary passages is blocked. Further, the closure may have curvature and be slidable in a curved slot in the lower front wall structure, to control such passages.

It is a further object of the invention to provide:

(a) a shield carried by the helmet to have a downwardly closed position extending across said front opening, the shield also having an open position in which it is elevated relative to said closed position, (b) and control means associated with the helmet and shield for mechanically releasing the shield from such closed position and for yieldably urging the shield toward and into the full open position.

In this regard, the shield may have an intermediate position between said closed and open positions and into which the shield is initially urged, and releasably retained, by the control means; and the control means is typically located on at least one of said helmet sidewall structures, proximate a pivoted connection of the shield to the helmet.

Further, the shield position control means may include (i) a spring urged latch movable between selected positions in one of which the shield engages the latch in shield fully closed position and in another of which the shield has rotated to engage the latch in shield partly open position, (ii) spring urged means biasing the shield in a rotary direction toward engagement with the latch in both of said latter positions.

It is a still further object of the invention to provide a pad positioned in the helmet to receive air flowing from the passage means, for passing air through the pad to exhaust therefrom at the rear of the helmet. That pad may advantageously include:

(i) an upright cap having a depending skirt, (ii) and a collar attached to and extending outwardly from lower extent of the skirt, thereby to form an air flow space between the helmet side wall structure and the pad, above the collar and outwardly of the skirt.

Further, the collar may form at least one vent opening to pass air downwardly from said flow space to the helmet exterior; and the pad typically includes air permeable reticulated foam to freely pass air flow, and other flexible material to deflect and guide air flow relative to said reticulated foam, said other material defining said at least one vent opening. Also, left and right pad cheek pieces may be provided, for helmet stability.

These and other objects and advantages of the invention, as well as the details of an illustrative embodiment, will be more fully understood from the following specification and drawings, in which:

DRAWING DESCRIPTION

DETAILED DESCRIPTION

Figure 1:
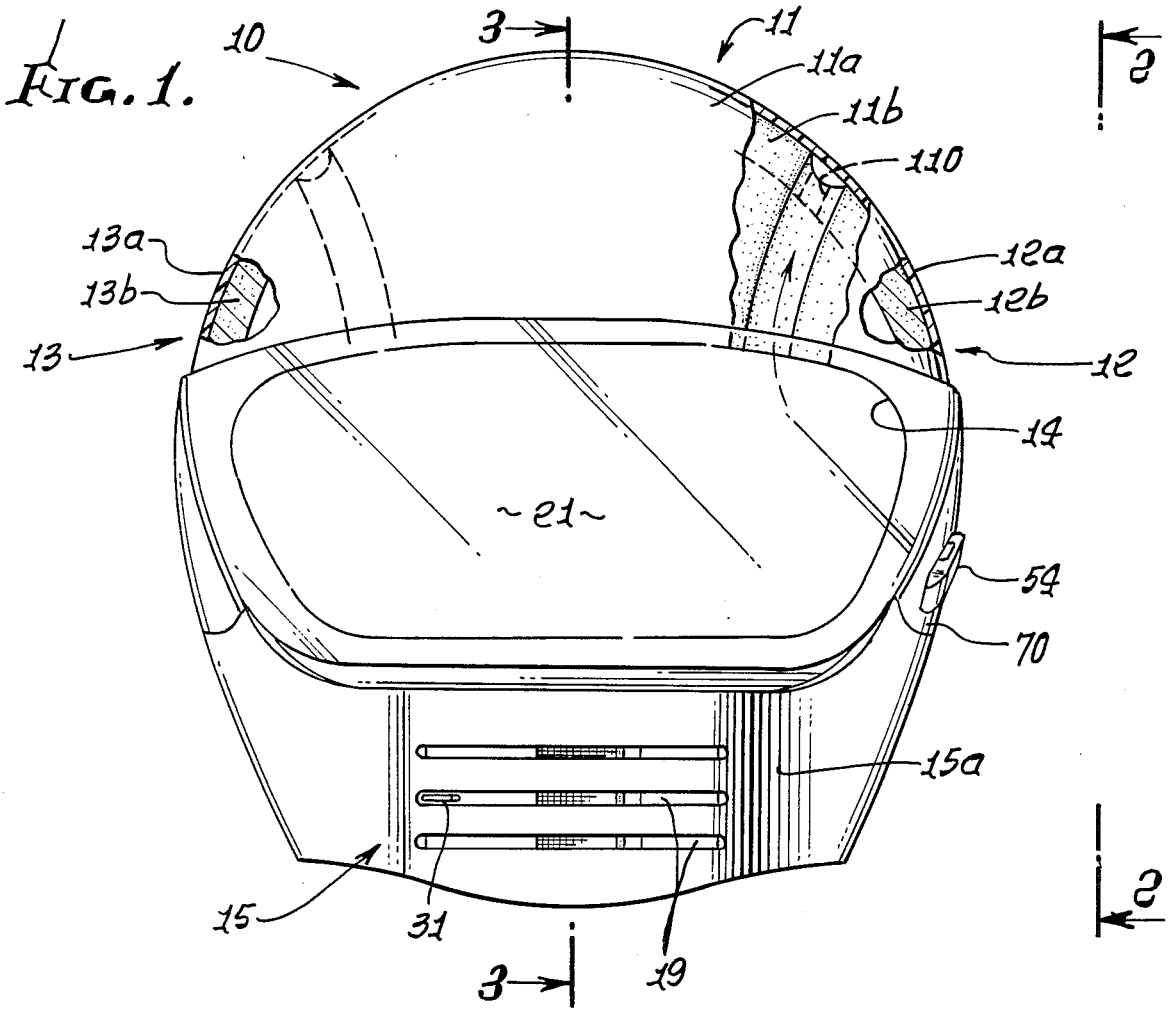
FIG. 1 is a frontal view of a helmet incorporating the invention.
Figure 2:
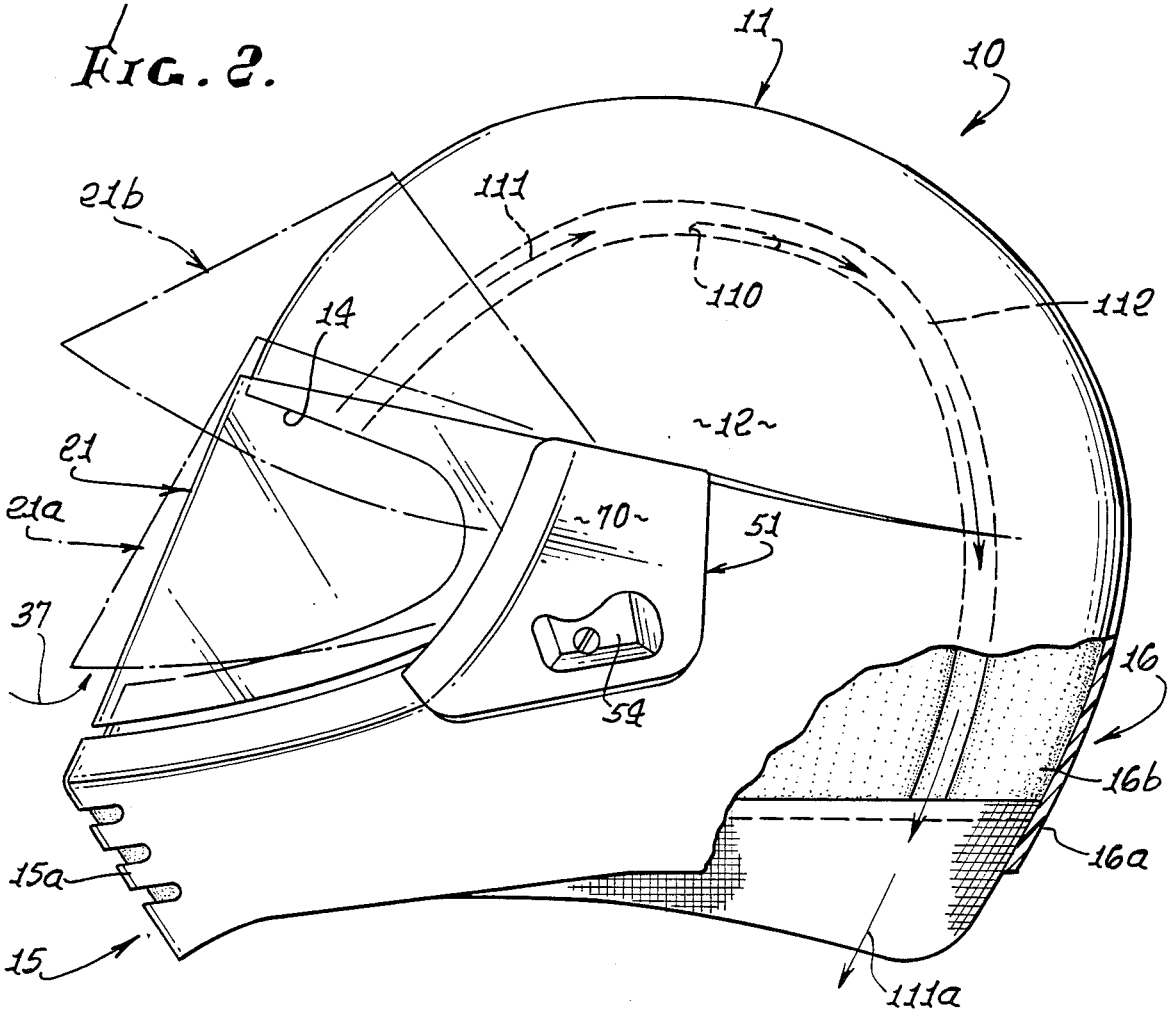
FIG. 2 is a side elevation taken on lines 2—2 of FIG. 1.
Figure 4:
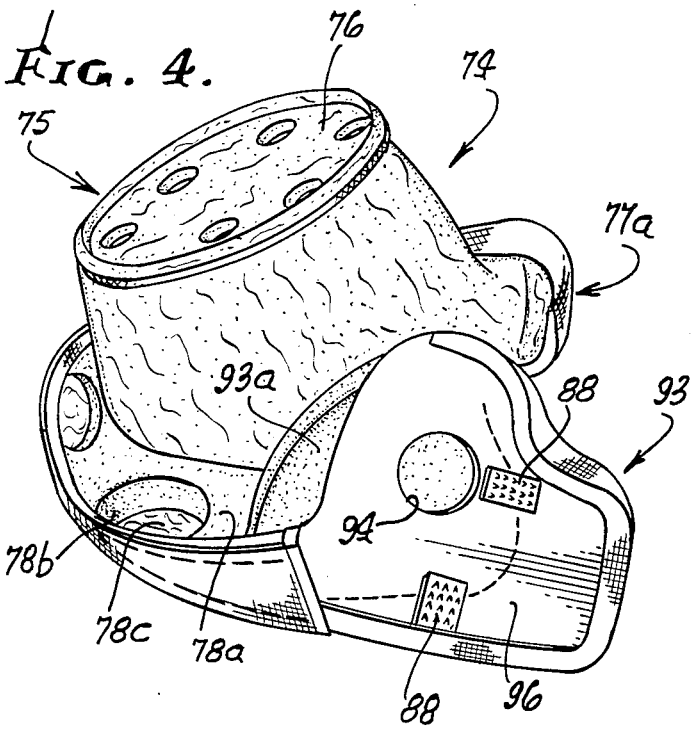
FIG. 4 is a perspective view of a fit pad assembly removably received in the interior of the helmet shown in FIGS. 1-3.
Figure 3:
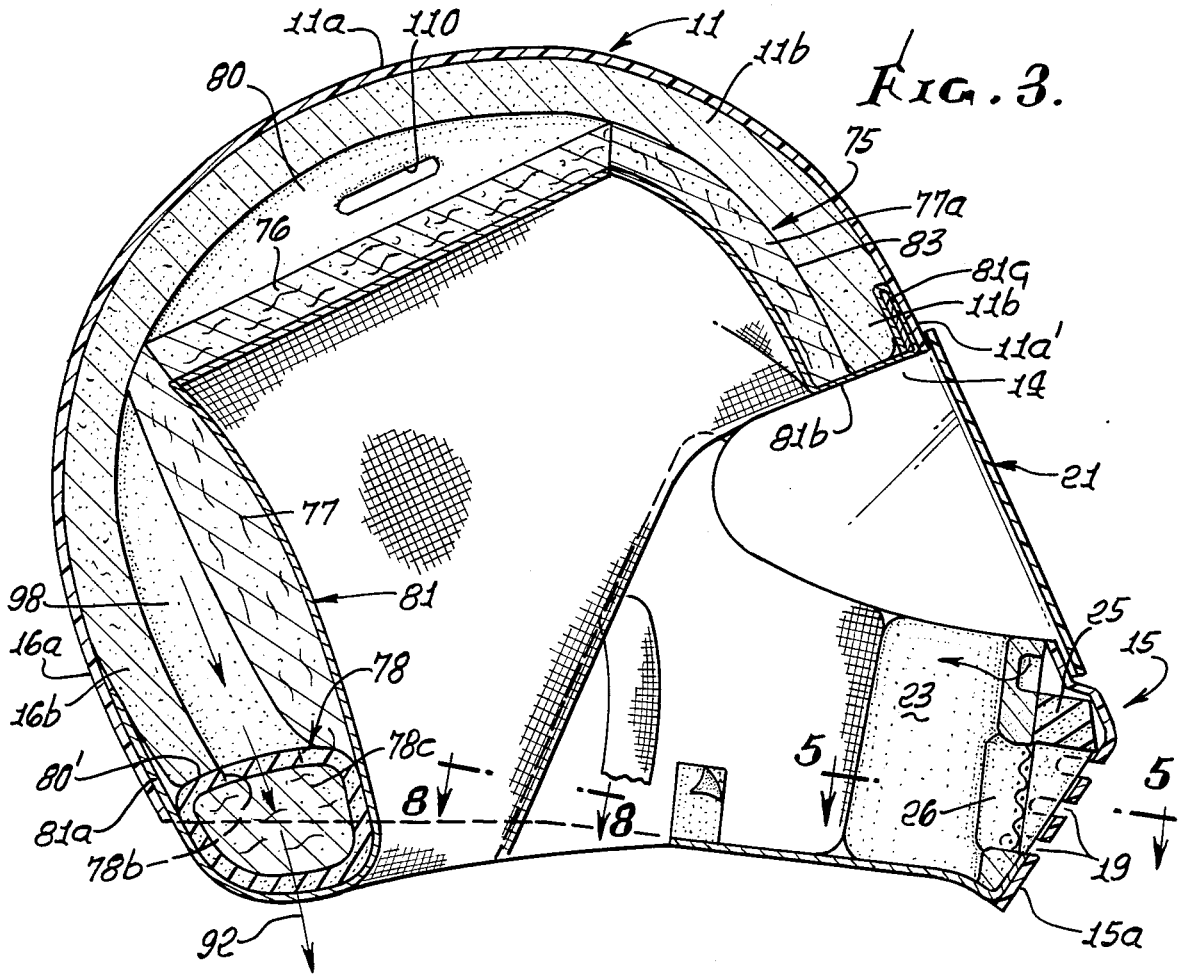
FIG. 3 is a section taken in elevation on lines 3—3 of FIG. 1.

In FIGS. 1, 2, and 3, the helmet 10 is shown as of the type worn by bicyclists and motorcyclists. It has a dome shaped top wall structure 11, opposite side wall structures 12 and 13, a front opening 14 to enable forward viewing, a lower front portion 15 having forwardly V-shaped structure which juts or projects forwardly generally beneath the front opening 14, and rear wall structure 16, all as illustrated, for example. Such wall structures may be defined by an outer shell, and also (at certain locations) by an inner liner, with corresponding walls 11*a*, 11*b*; 12*a*, 12*b*; 13*a*, 13*b*; 15*a*; and 16*a* and 16*b*. In FIG. 3, the liner portion 11*b* extends downwardly and forwardly to a terminal location 11*b'* spaced inwardly from the shell terminal location 11*a'*, just above front opening 14. The thin outer shell may consist of laminated, hard plastic material (polycarbonate), and the liner may consist of softer, molded plastic material such as rigid foamed plastic (polyurethane).

In accordance with one aspect of the invention, a frontwardly facing air inlet means is defined by the front wall structure 15; and a closure is carried by the helmet front wall structure 15 for movement controlling passage means in the helmet that receives air inflow for circulation to different portions of the helmet interior and subsequent flow to the helmet exterior. Extending the description to FIGS. 5–7, the inlet means is depicted by horizontal slits 19 through shell wall 15*a*, and the passage means is shown to include a primary passage 20 to direct inflowing air upwardly toward the inner side of a shield 21 carried by the helmet. One purpose is for defogging the shield (i.e. removing condensation on the shield of moisture from the users breath). Passage 20 may be formed between a plate 22 and face piece 23, the latter relieved as shown at 20*a* in FIG. 7 and having upward discharge ports 20*b*. The wall elements 22 and 23 may comprise a subassembly, attached to the helmet shell as by adhesive indicated at 24 in FIG. 7. The sub-assembly may also include a top spacer 25 seen in FIG. 6. Elements 22, 23, and 25 may consist of rigid, molded plastic material.

The passage means may also include a secondary passage 26 to direct inflowing air centrally rearwardly (see arrows 26*a* in FIG. 5) toward the helmet interior, for flow around the wearer's head, and into a reticulated pad material, to be described, for ventilation. The closure, indicated at 29 is movable in controlling relation with passages 20 and 26. It may take the form of a panel slidable generally sidewardly between multiple positions, and in a slot 28 formed by the guide wall 22. FIG. 6 shows that wall as having U-shaped edge portions to slidably retain the door. The slot 28 and door 29 are frontwardly convexly curved, as are elements 22, 23 and 15, so that the door is configured to slide left and right in adjustable registration with the primary and secondary passages 20 and 26.

Figure 7:
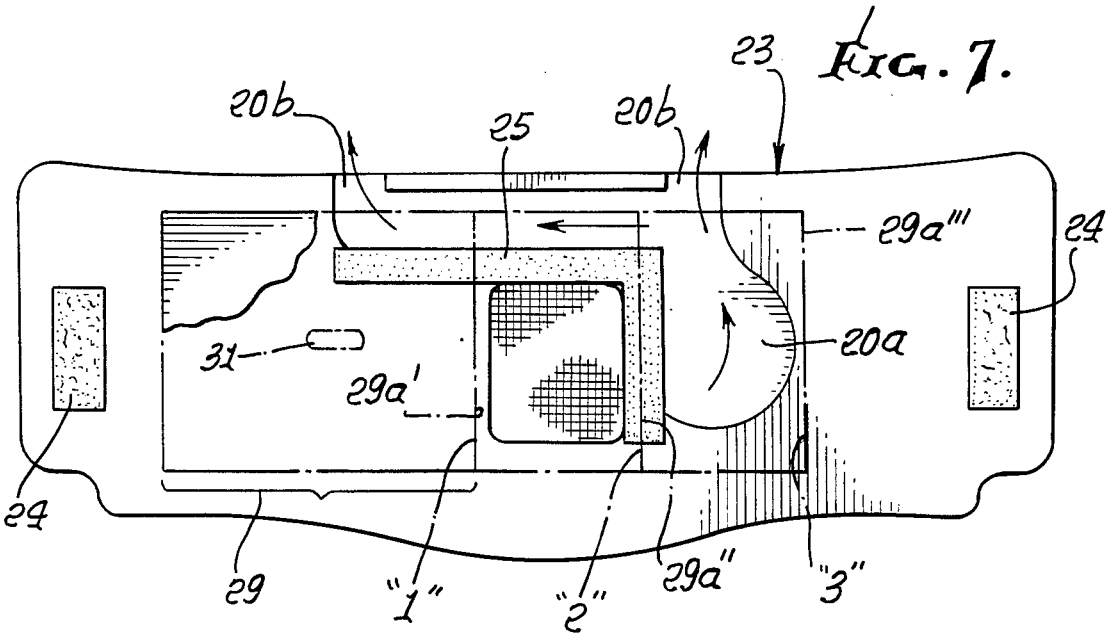
FIG. 7 is a section taken on lines 7—7 of FIG. 5, and showing details of a door guide.
Figure 5:
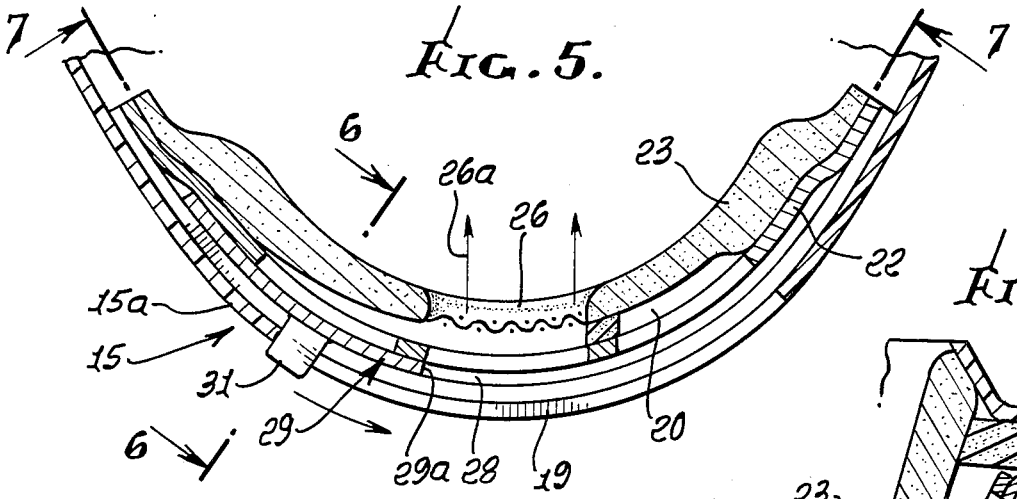
FIG. 5 is a fragmentary section taken on lines 5—5 of FIG. 3.
Figure 6:
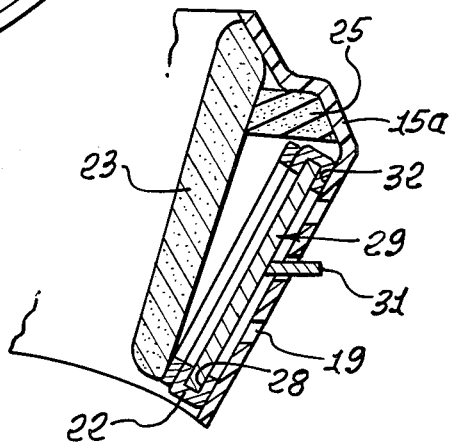
FIG. 6 is a section taken on lines 6—6 of FIG. 5.
Figure 9:
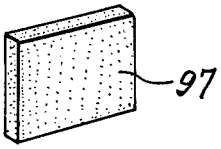
FIG. 9 is a perspective view of a cheek jack.

In this regard, and referring to FIGS. 5 and 7, the closure or door has a first position (see door edge 29*a'* at position "1" in FIG. 7) in which air inflow is passed by both passages 20 and 26; a second position (see door edge 29*a''* at position "2" in FIG. 7) in which air inflow is passed by only one of the passages 20 and 26 (typically passage 26 is closed and passage 20 is open); and a third position (see door edge 29*a'''* in FIG. 7 in which inflow of air through both passages 20 and 26 is blocked). Such door sliding movement is enabled by means of a handle 31 integral with the door, and projecting forwardly through one of the auxiliary slots 19 (see FIG. 6) to be forwardly presented for manual manipulation, back and forth. Note also that the helmet front wall is forwardly recessed at 32, to nest the subassembly that includes guide wall 22 and door 26.

FIG. 2 shows the transparent plastic shield panel 21 as wrapping about the helmet forward extent, and as carried by the helmet to have multiple positions. The shield has a downwardly closed position (see solid lines 21) in which the shield extends protectively across the helmet front viewing opening 14; also, the shield has a fully open position indicated by broken lines 21*b*, in which the shield is fully elevated; and an intermediate position indicated by broken lines 21*a*, in which the shield is partly elevated. Moved to the latter position, the shield still protects the wearer's eyes from the full force of air impact; however, the shield enables inflow of a stream of air under the lower front lip of the shield, to help defog the shield inner surface. See arrow 37 showing the air curling under the shield lower forwarded lip and rising at the inside of the shield. Also, such air is caused to ventilate the helmet interior, as by flow by and through a protection pad structure, to be described.

A control means is provided in association with the helmet and shield for mechanically releasing the shield from its closed (down) position, and for yieldably urging the shield toward and into open position. Note in this regard that the transparent shield is pivotally connected to the helmet at left and right side pivot locations 50. The control means 51 typically is located on at least one of the helmet side wall structures, as for example on left side wall structure 12, as seen in FIGS. 2 and 10–16.

As shown, the control means includes a spring urged element generally indicated at 52 tending to rotate the visor or shield about the pivot 50 toward fully open position; and a latch mechanism 53 which blocks shield rotation until unlatching occurs, as by operation of control button 54.

Figure 10:
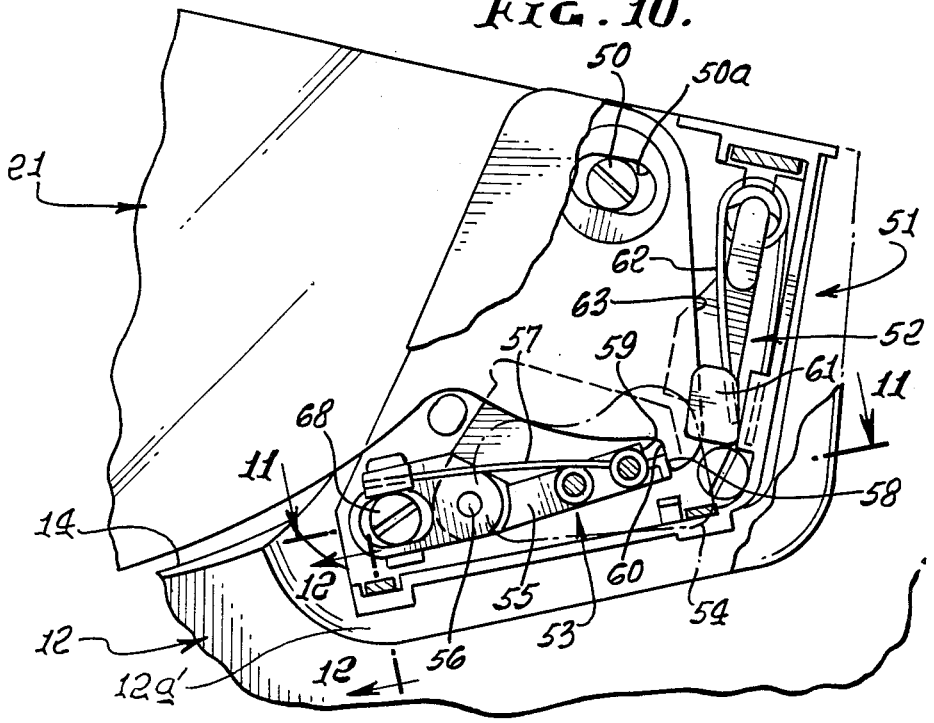
FIG. 10 is a fragmentary side elevation showing details of a shield activating mechanism, the shield being in closed position.
Figure 11:
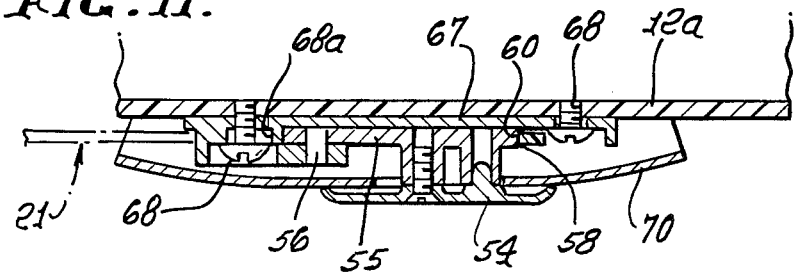
FIG. 11 is a fragmentary section taken on lines 11—11 of FIG. 10.
Figure 12:
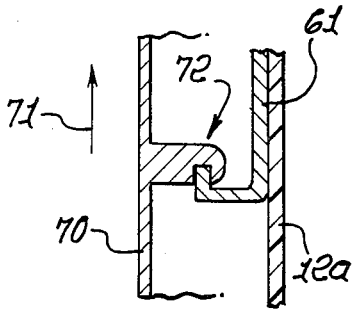
FIG. 12 is an enlarged section taken on lines 12—12 of FIG. 10.
Figure 13:
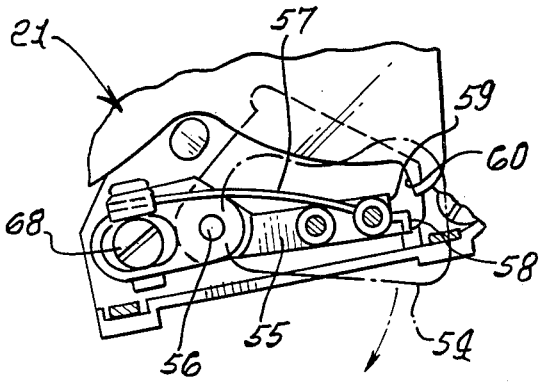
FIG. 13 is a view showing details of the shield activating mechanism of FIG. 10, with a rocker depressed.
Figure 16:
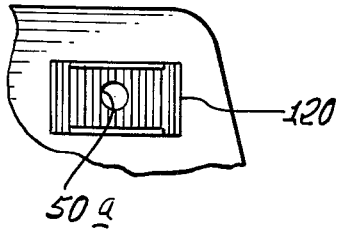
FIG. 16 shows structure associated with adjustable pivoting of the shield to the shell.
Figure 14:
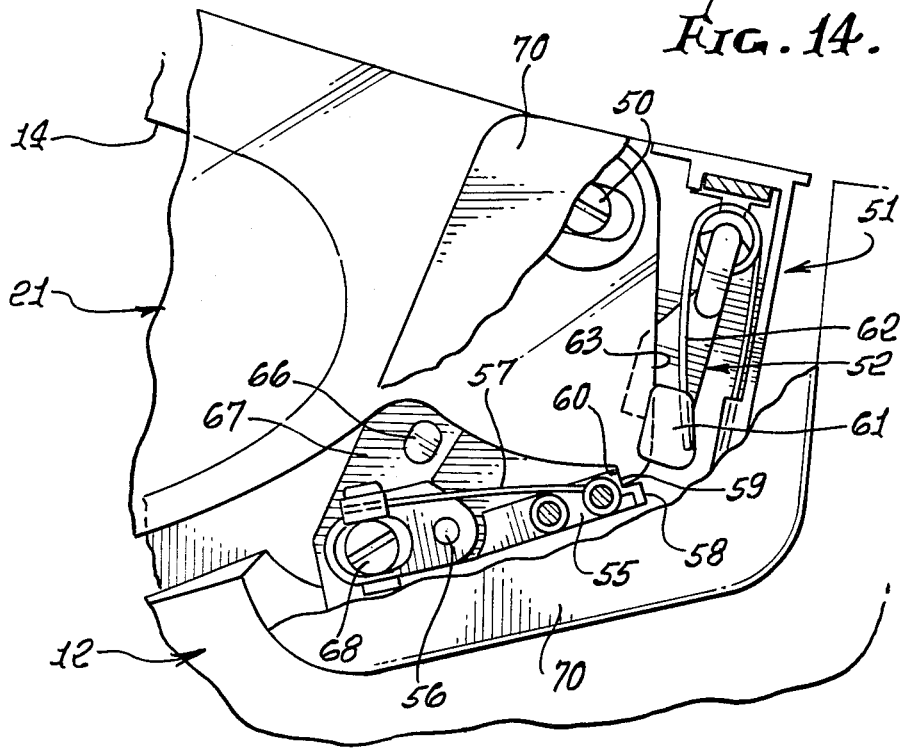
FIG. 14 is a view like FIG. 10, showing the shield in partly open, defog position.
Figure 15:
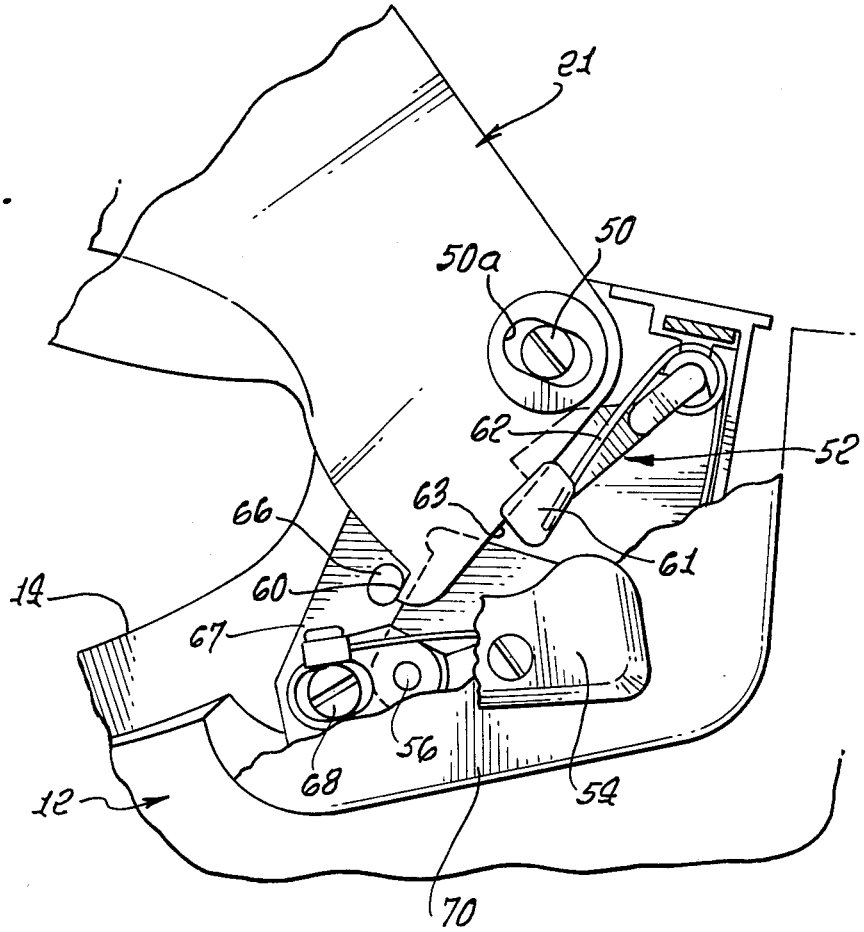
FIG. 15 is a view like FIG. 10, showing the shield in fully open position.

The latch includes rocker arm 55, pivoted at 56, and spring urged by spring arm 57 in a counter clockwise direction, i.e. upwardly in FIGS. 10, 13, 14 and 15. The arm 55 has first and second blocking shoulders 58 and 59. In FIG. 10, the first shoulder 58 engages the lip 60 of the shield to block shield rotation at closed position, the cam element 61 on spring arm 62, engaging the follower edge 63 of the shield and thereby urging lip 60 against shoulder 58. When arm 55 is depressed slightly downwardly, by manual deflection of button 54, the lip 60 releases from blocking shoulder 58 and is deflected clockwise (by spring 62 and cam 61 pushing on the shield followed edge 63) to quickly engage the second stop shoulder 59, offset from shoulder 58 so that the shield pivots a predetermined angular amount, into partly open position. See FIG. 14. Thereafter, when arm 55 is depressed further, the lip 60 rides over the upper edge of shoulder 59, and the shield is freed to pivot upwardly into fully open position (urged by spring 62), until lip 60 engages a stop 66 integral with base plate 67. The above described control elements are typically carried by the base plate, which is attached as by fasteners 68, to the helmet outer shell 12*a*. See FIG. 11. A protective cover 70 for the control mechanism may be removed by sliding in direction 71 (see FIG. 12), therebeing a releasable connection at 72 between the cover and base plate.

Referring now to FIGS. 2–4 and 9, a further feature of the invention concerns the provision of pad structure positioned in the helmet (and which may be removable from the helmet) to further protect the wearer's head, to absorb perspiration, and to receive air inflow (in the various control door position) for passing air through the pad to ventillate the helmet and pad, and to exhaust air generally at the rear and/or lower sides of the helmet.

As shown, the pad 74 includes an upright cap or hat 75, having a top cover 76, depending skirt 77, and a collar 78 attached to and extending outwardly from lower extent of the skirt and toward the helmet liner structures 12*a*, 13*a* and 16*a*. As a result a ventilating air flow space is formed about the hat at 98, and another such space 80 is formed between top cover 76 and the helmet dome liner 11*b*. The skirt forward extent 77*a* may engage the front liner at locus 83, for firm location and support. Collar 78 seats upwardly against the bottom of the rear liner 16*b*, at location 80. A skirt and collar fabric lining sheet (air permeable) 81 projects at 81*a* to fit between the liner shell 16*a* and liner 16*b*; and also projects at 81*b* and 81*c* beneath front liner 11*b'* and upwardly into space between shell 11*a'* and liner 11*b'*, for retention of the padding in position.

The padding includes air permeable, reticulated foam to freely pass air flow, and also includes other flexible material such as polyester foam which deflects air flow, i.e. is not permeable. The hat 75 may consist of the reticulated foam, for good air flow through the upper interior of the helmet; and the collar extents 78*a* may consist of polyester foam. They form vertical through vents at 78*b* through which air is drawn downwardly from space 98 to pass through the reticulated foam portions 78*c* of the collar, and downwardly to the exterior, as at the rear of the helmet. See arrows 92 in FIG. 3.

Figure 8:
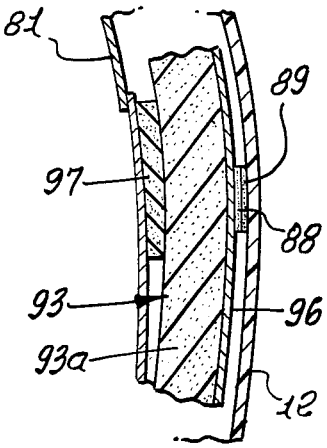
FIG. 8 is a section on lines 8—8 of FIG. 3 showing liner attachment to the helmet shell.

The padding also may include integral left and right cheek protectors 93, consisting of reticulated foam at 93*a* and vented at 94 to more freely pass air circulation. The cheek protectors fit between the sides of the wearer's head, and the helmet to enhance helmet stability. The padding may made easily removable, through use of hook and pile attachments 88 and 89, affixed to the helmet and to the cheek protectors. The latter are lined with fabric as at 96. See FIG. 8. Cheek "jack" pieces appear at 97, and are of selected width to accomodate to the size of the wearer's head.

Finally, FIGS. 2 and 3 show one or more openings 110 in the top side of the helmet shell to ventilate space 80, between hat cover 76 and the liner 11*b*. Note that air entering the helmet, as by flowing upwardly adjacent the inner side of the shield, passes upwardly, rearwardly and downwardly, as indicated by arrows 111, to exhaust at 111*a*. Such flow may be within the reticulated foam of the padding; or other grooving in the liner 11*a* and 16*a* opening toward the padding, an as indicated by broken lines 112 in FIG. 2.

The base plate 67 and tilt control mechanism for the shield are formed by the shell 12*a*, so that the outer flush contour of the shell remainder is maintained.

Slots in plate 67, as at 50*a* and 68*a*, allow limited slidable adjustment of the base plate 67 relative to the inwardly dsplaced shell wall portion 12*a'* to which the base plate is attached, thereby to adjustably position the shield associated tilt control mechanism, prior to tightening of the attachment fasteners, as at 68.

At the opposite side of the shell, the shield is pivotally attached to the shell wall at pivot location 50*a*. Associated with the latter, and attached to the shell, is a serrate pad 120 which engages the inner side of the shield proximate the pivot location to lightly frictionally grip the shield but also allow pivoting of same, as described. The shield may have appropriate notching for a fastener at location 50*a*, and to allow limited adjustment of the shield parallel to the shell wall, to correspond to adjustment of base plate 67, as described.

I claim:

1. In a motorcyclist or bicyclist helmet having dome shaped top wall structure, side wall structures, a front opening for forward viewing, a shield associated with said front opening, a lower front wall structure which juts forwardly, and rear wall structure, the combination comprising (a) a frontward facing air inlet means defined by said lower front wall structure, (b) passage means in the helmet to receive air inflow from said inlet means for circulation to different portions of the interior of the helmet and subsequent flow to the helmet exterior, (c) and a closure carried by the helmet front wall structure for movement adjustably controlling said passage means, said helmet wall structure including a shell, (d) there being wall elements rearwardly of said closure and defining a sub-assembly attached to said shell, said elements defining said passage means which includes a primary passage to direct inflowing air upwardly toward the inner side of said shield, and a secondary passage to direct inflowing air rearwardly toward the interior of the helmet, (e) said closure movable laterally rearwardly of said air inlet means between a first position in which air inflow is passed by both said primary and secondary passages, and a second position in which air inflow is passed by only one of said primary and secondary passages, and a third position in which passage of air inflow by both said primary and secondary passages is blocked.

2. The combination of claim 1 wherein said one passage is said primary passage.

3. The combination of claim 1 wherein said lower front wall structure is frontwardly convexly curved and defines a correspondingly curved slot in registration with said air inlet means and said primary and secondary passages, and said closure is likewise frontwardly convexly curved and configured to slide in said slot in adjustable registration with said primary and secondary passages.

4. The combination of claim 3 including a handle integral with said closure, and projecting forwardly through an auxiliary slit in said lower front wall structure to be forwardly presented for manual manipulation to slide the closure in the slot.

5. The combination of claim 1 wherein the shield has a downwardly closed position closing said helmet front opening and in which said primary opening discharges upwardly in proximity to the inside lower extent of the shield, the shield also having an open position in which it is elevated relative to said closed position.

6. The combination of claim 5 wherein the shield also has an intermediate position between said shield open and closed positions, and including control means associated with the helmet and shield for mechanically controlling movement of the shield between said positions.

7. The combination of claim 1 including a protective pad positioned in the helmet to receive air flowing from said passage means, for passing air through the pad to exhaust therefrom at the rear of the helmet.

8. The combination of claim 7 wherein said pad includes (i) an upright cap having a depending skirt, (ii) and a collar attached to and extending outwardly from lower extent of the skirt, thereby to form air flow space between the helmet side wall structure and the pad, above the collar and outwardly of the skirt.

9. The combination of claim 8 wherein said collar forms at least one vent opening to pass air downwardly from said flow space to the helmet exterior.

10. The combination of claim 9 wherein the pad includes air permeable reticulated foam to freely pass air flow, and other flexible material to deflect and guide air flow relative to said reticulated foam, said other material defining said at least one vent opening.

11. The combination of claim 7 wherein the pad structure includes left and right cheek protectors projecting forwardly from said collar to engage the wearer's cheeks and thereby stabilize the helmet on the wearer's head.

12. The combination of claim 5 including control means associated with the helmet and shield for mechanically releasing the shield from said closed position and for yieldably urging the shield toward and into said open position.

13. The combination of claim 12 wherein the shield also has an intermediate position between said closed and open positions and into which the shield is initially urged, and releasably retained, by said control means.

14. The combination of one of claims 12 and 13 wherein said control means is located on at least one of said helmet side wall structures, proximate a pivoted connection of the shield to the helmet.

15. The combination of claim 14 wherein said control means includes (i) a spring urged latch movable between selected positions in one of which the shield engages the latch in shield fully closed position and in another of which the shield has rotated to engage the latch in shield partly open position, (ii) spring urged means biasing the shield in a rotary direction toward engagement with the latch in both of said latch positions.

16. The combination of claim 15 wherein the elements (i) and (ii) are carried by a base plate attached to one side of the helmet.

17. The combination of claim 15 including a manual control to deflect the latch to allow the shield to rotate out of engagement with a first stop shoulder on the latch and into engagement with a second stop shoulder on the latch and offset from the first stop shoulder.

18. The combination of claim 17 including a third shoulder associated with the base plate and engaged by the shield after it has disengaged both of said first and second stop shoulders, and when the shield has pivoted into fully open position.

19. The combination of claim 16 wherein said helmet one side wall structure is inwardly recessed to receive said base plate and control means.

20. The combination of claim 16 wherein said base plate has adjustable attachment to said helmet one side wall structure, thereby to allow limited adjustment shifting of the base plate relative to said side wall structure.

21. The combination of claim 16 including a second pivoted connection of the shield to an opposite side wall structure of the helmet, and pad means proximate said second pivoted connection to grip the shield but allow pivoting thereof.

* * * * *